US009291959B1

(12) United States Patent
Sawai et al.

(10) Patent No.: US 9,291,959 B1
(45) Date of Patent: Mar. 22, 2016

(54) IMAGE FORMING APPARATUS AND IMAGE FORMING METHOD

(71) Applicant: FUJI XEROX CO., LTD., Tokyo (JP)

(72) Inventors: Kenji Sawai, Kanagawa (JP); Yoshiyuki Tominaga, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/832,061

(22) Filed: Aug. 21, 2015

(30) Foreign Application Priority Data

Feb. 25, 2015 (JP) ..... 2015-035793

(51) Int. Cl.
*G03G 15/20* (2006.01)

(52) U.S. Cl.
CPC ..... *G03G 15/2028* (2013.01); *G03G 15/2046* (2013.01)

(58) Field of Classification Search
CPC ..... G03G 15/2028; G03G 15/2046
USPC ..... 399/53, 69
See application file for complete search history.

(56) References Cited

U.S. PATENT DOCUMENTS

| | | | | |
|---|---|---|---|---|
| 9,008,529 | B2 * | 4/2015 | Kiuchi | 399/67 |
| 2009/0154948 | A1 * | 6/2009 | Cahill et al. | 399/69 |
| 2014/0356008 | A1 | 12/2014 | Harashima et al. | |

FOREIGN PATENT DOCUMENTS

| | | | |
|---|---|---|---|
| JP | 2006-317632 | A | 11/2006 |
| JP | 2014-235346 | A | 12/2014 |

* cited by examiner

*Primary Examiner* — Hoang Ngo
(74) *Attorney, Agent, or Firm* — Sughrue Mion, PLLC

(57) ABSTRACT

An image forming apparatus includes a transfer body that transfers an image formed with toner containing a flat pigment to a recording medium; and a fixing unit that, when the image having an area coverage that is greater than or equal to a predetermined area coverage occupies a width that is less than a predetermined width of the recording medium, fixes the image to the recording medium with fixing energy having a first value, and that, when the image having the area coverage that is greater than or equal to the predetermined area coverage occupies a width that is greater than or equal to the predetermined width of the recording medium, fixes the image to the recording medium with fixing energy having a second value, the second value being greater than the first value.

7 Claims, 7 Drawing Sheets

FIG. 7A
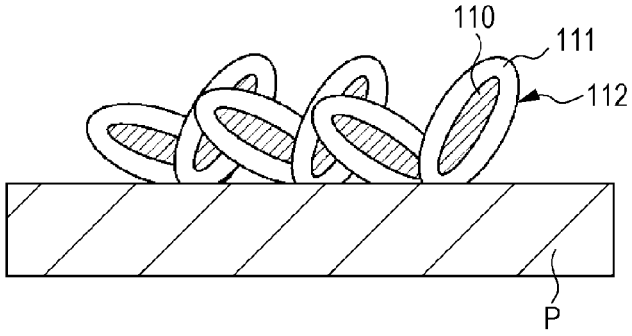
FIG. 7B
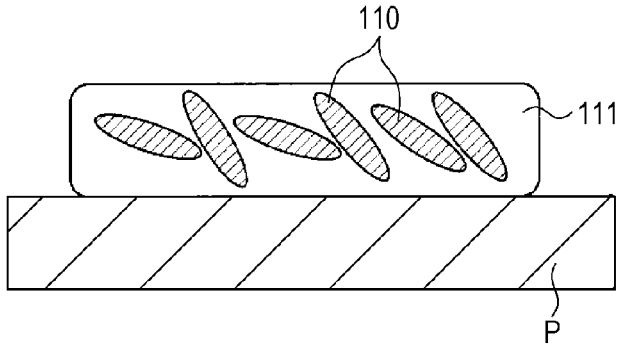
FIG. 7C
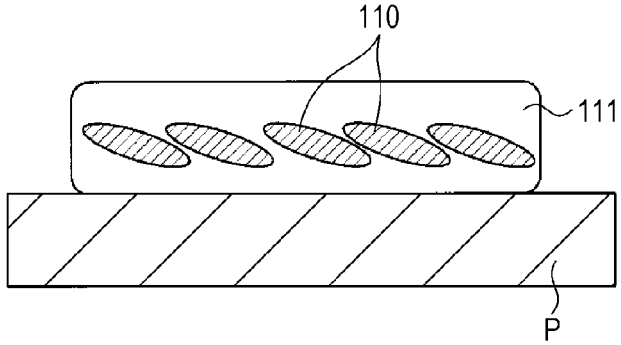
FIG. 8
| FIXING TEMPERATURE (°C) | TMA (g/m$^2$) | EVALUATION |
|---|---|---|
| 155 | 4.5 | C |
| 180 | 4.5 | A |
| 150 | 5.0 | C |
| 160 | 5.0 | B |
| 170 | 5.0 | A |
| 180 | 5.0 | A |

FIG. 9A
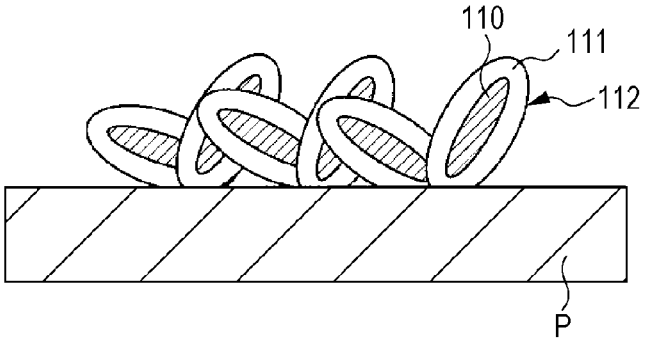
FIG. 9B
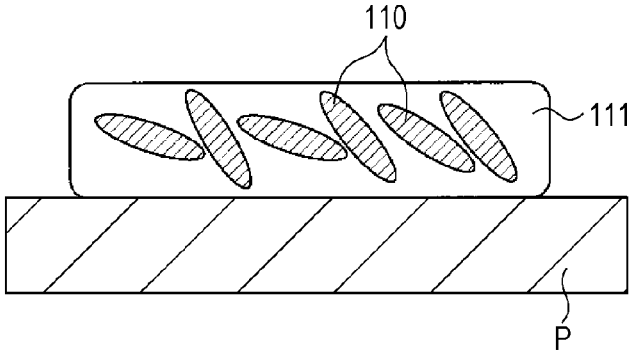
FIG. 9C
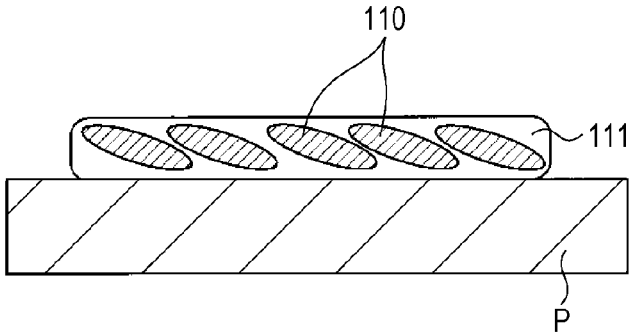
FIG. 10
| FIXING TEMPERATURE (°C) | TMA (g/m$^2$) | EVALUATION |
|---|---|---|
| 155 | 5.0 | C |
| 155 | 4.5 | C |
| 155 | 4.0 | C |
| 155 | 3.5 | B |
| 155 | 3.0 | A |

IMAGE FORMING APPARATUS AND IMAGE FORMING METHOD

CROSS-REFERENCE TO RELATED APPLICATIONS

This application is based on and claims priority under 35 USC 119 from Japanese Patent Application No. 2015-035793 filed Feb. 25, 2015.

BACKGROUND

Technical Field

The present invention relates to an image forming apparatus and an image forming method.

SUMMARY

According to an aspect of the invention, there is provided an image forming apparatus including a transfer body that transfers an image formed with toner containing a flat pigment to a recording medium; and a fixing unit that, when the image having an area coverage that is greater than or equal to a predetermined area coverage occupies a width that is less than a predetermined width of the recording medium, fixes the image to the recording medium with fixing energy having a first value, and that, when the image having the area coverage that is greater than or equal to the predetermined area coverage occupies a width that is greater than or equal to the predetermined width of the recording medium, fixes the image to the recording medium with fixing energy having a second value, the second value being greater than the first value.

BRIEF DESCRIPTION OF THE DRAWINGS

Exemplary embodiments of the present invention will be described in detail based on the following figures, wherein:

FIG. 7A is a schematic view of a state of toner containing flat pigments before a fixing operation in a first exemplary embodiment;

FIG. 7B is a schematic view of a state of toner containing flat pigments when it has been fixed at a first fixing temperature in the first exemplary embodiment;

FIG. 7C is a schematic view of a state of toner containing flat pigments when it has been fixed at a second fixing temperature that is higher than the first fixing temperature in the first exemplary embodiment;

FIG. 8 is a table of the results of evaluation regarding the first exemplary embodiment;

FIG. 9A is a schematic view of a state of toner containing flat pigments before a fixing operation in a second exemplary embodiment;

FIG. 9B is a schematic view of a state of toner containing flat pigments when it has been fixed at a first fixing temperature in the second exemplary embodiment;

FIG. 9C is a schematic view of a state of toner containing flat pigments when it has been fixed at a second fixing temperature that is higher than the first fixing temperature; and FIG. 10 is a table of the results of evaluation regarding the second exemplary embodiment.

DETAILED DESCRIPTION

An exemplary embodiment of the present invention is hereunder described with reference to the drawings. In each figure, a double-headed arrow H represents vertical directions, and a double-headed arrow W represents horizontal directions, which are width directions of an apparatus.

First Exemplary Embodiment

Structure of Image Forming Apparatus 10

Figure 1:
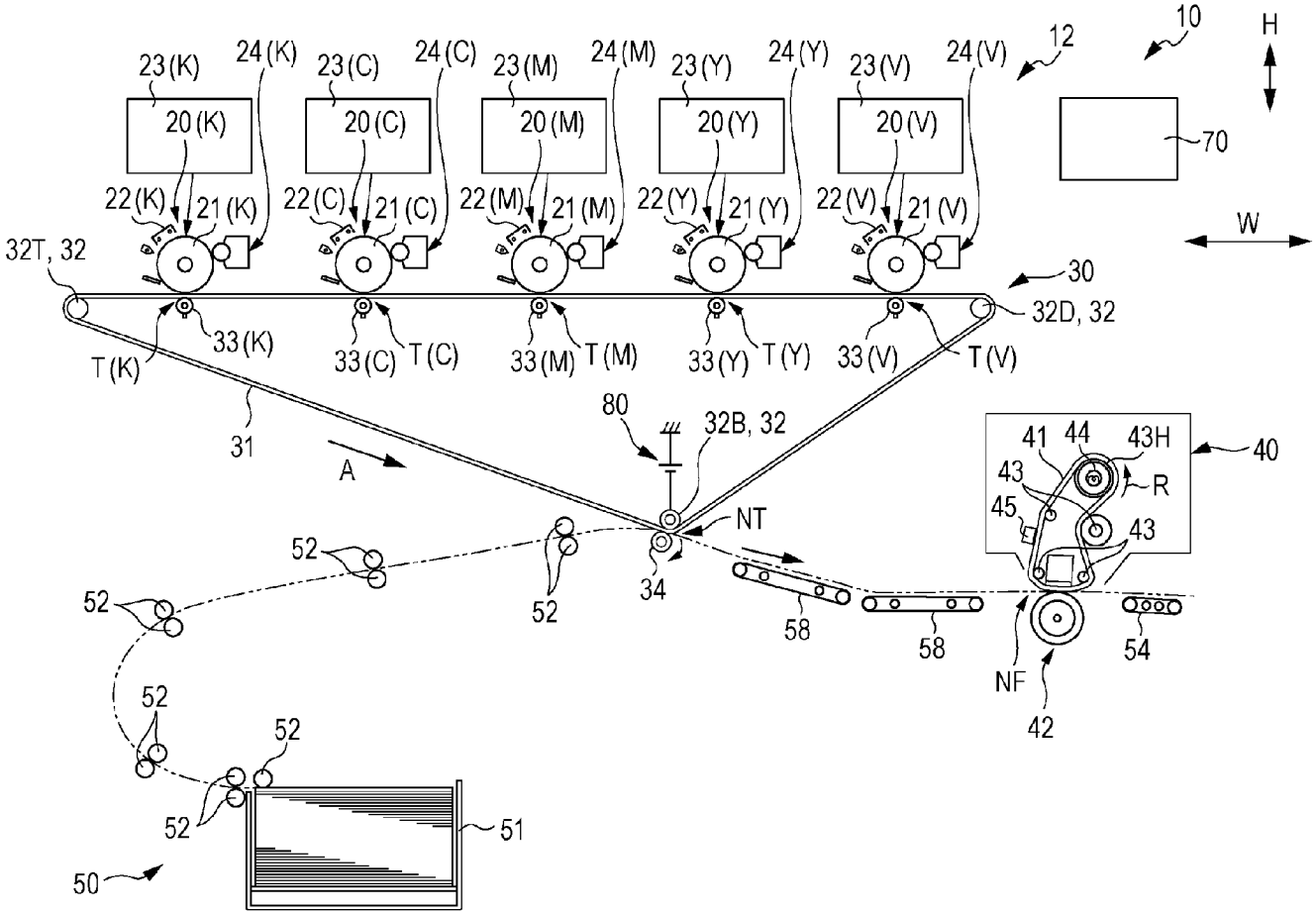
FIG. 1 is a schematic view of an image forming apparatus according to an exemplary embodiment.

FIG. 1 is a schematic front view of a structure of an image forming apparatus 10. As shown in FIG. 1, the image forming apparatus 10 includes an image forming device 12, a transporting device 50, and a controller 70. The image forming device 12 forms an image on a recording medium P, such as a sheet, with an electrophotographic system. The transporting device 50 transports a recording medium P. The controller 70 controls the operation of each portion of the image forming apparatus 10.

Transporting Device 50

As shown in FIG. 1, the transporting device 50 includes a holding unit 51 that holds recording media P, and transporting rollers 52 that transport the recording media P from the holding unit 51 to a second transfer position NT. The transporting device 50 further includes transporting belts 58 and a transporting belt 54. The transporting belts 58 transport the recording media P from the second transfer position NT to a fixing device 40. The transporting belt 54 transports the recording media P from the fixing device 40 to a discharge unit (not shown) for the recording media P.

Image Forming Device 12

The image forming device 12 includes toner image forming units 20, a transfer device 30, and the fixing device 40 (exemplary fixing unit). The toner image forming units 20 form toner images. The transfer device 30 transfers the toner images formed on the toner image forming units 20 to a recording medium P. The fixing device 40 heats and presses the toner images transferred to the recording medium P, and fixes the toner images to the recording medium P.

The toner image forming units 20 are provided for forming the toner images for corresponding colors. In the exemplary embodiment, a total of five toner image forming units 20 for five colors, that is, yellow (Y), magenta (M), cyan (C), black (K), and a special color (V), are provided. The toner image forming units 20 for the corresponding colors are disposed from an upstream side to a downstream side in a transport direction of a transporting belt 31 (described later) in the order of the toner image forming unit 20 for the special color (V), the toner image forming unit 20 for yellow (Y), the toner image forming unit 20 for magenta (M), the toner image forming unit 20 for cyan (C), and the toner image forming unit 20 for black (K).

The image forming device 12 is provided with the toner image forming units 20 for yellow (Y), magenta (M), cyan (C), and black (K) as standard units. Yellow (Y), magenta (M), cyan (C), and black (K) are standard colors. On the other hand, the toner image forming unit 20 for the special color (V) is formed as, for example, a toner image forming unit 20 that is capable of being additionally provided as an optional unit.

(V), (Y), (M), (C), and (K) shown in FIG. 1 represent structural portions for the corresponding colors mentioned above. In the description of the specification, (V), (Y), (M), (C), and (K) may be indicated as V, Y, M, C, and K without the parentheses. For the special color (V), for example, silver or gold is used. In the exemplary embodiment, as described below, an example in which the color silver is used as the special color (V) for toner that contains flat pigments is given. The toner that contains flat pigments may also contain pigments other than flat pigments.

Toner Image Forming Units 20

Figure 2:
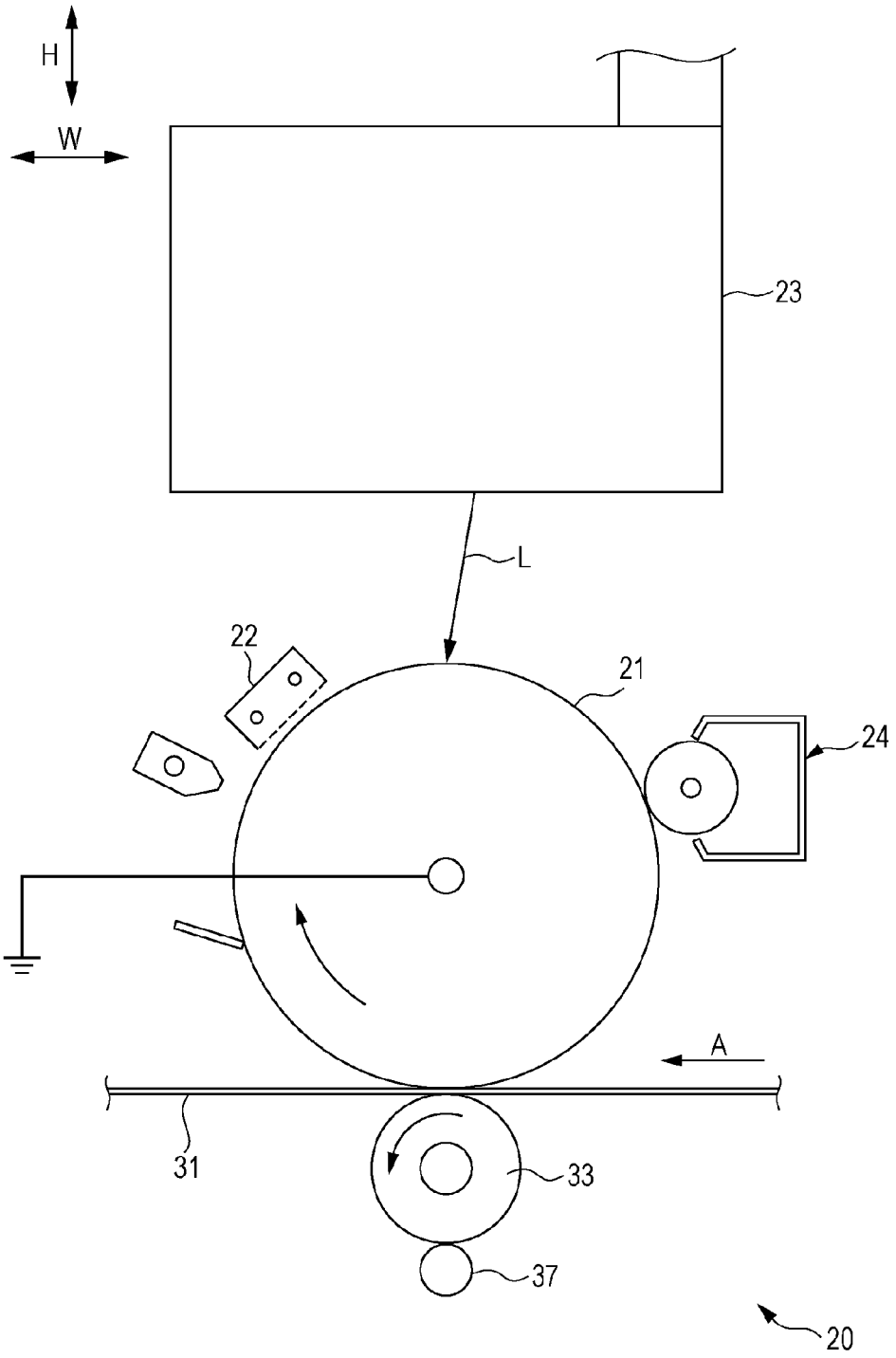
FIG. 2 is a schematic view of a toner forming unit according to the exemplary embodiment.

The toner image forming units 20 for the corresponding colors basically have the same structure except that they use different toners. More specifically, referring to FIG. 2, each toner image forming unit 20 for its corresponding color includes a photoconductor drum 21 that rotates clockwise in FIG. 2 and a charging unit 22 that charges the corresponding photoconductor drum 21. Each toner image forming unit 20 for its corresponding color further includes an exposure device 23 that exposes the photoconductor drum 21 charged by the charging unit 22 to form an electrostatic latent image on the photoconductor drum 21, and a developing device 24 that develops the electrostatic latent image formed on the photoconductor drum 21 by the exposure device 23 to develop the electrostatic latent image and form a toner image.

More specifically, each exposure device 23 irradiates its corresponding photoconductor drum 21 with exposure light modulated in accordance with image data (exemplary image information) acquired by the controller 70 to form the electrostatic latent image on the corresponding photoconductor drum 21. Each electrostatic latent image is developed by its corresponding developing device 24, to form a toner image based on the image data. As the image data acquired by the controller 70, for example, image data generated by an external device (not shown) and acquired from the external device is available.

Transfer Device 30

The transfer device 30 causes the toner images on the photoconductor drums 21 for the corresponding colors to be superposed upon and to be first-transferred to the transfer belt 31 (intermediate transfer body), to second-transfer the toner images that have been superposed upon the transfer belt 31 to a recording medium P at the second transfer position NT. More specifically, as shown in FIG. 1, the transfer device 30 includes the transfer belt 31, first transfer rollers 33, and a second transfer roller 34. The transfer belt 31 serves as an exemplary transfer body to which the toner images are transferred and that transfers the toner images to the recording medium P.

Transfer Belt 31

As shown in FIG. 1, the transfer belt 31 is an endless belt, and is wound upon rollers 32 such that its orientation is determined. In the exemplary embodiment, in front view, the transfer belt 31 is an inverted obtuse-angled triangle that is long in the width directions of the apparatus. Of the rollers 32, a roller 32D shown in FIG. 1 functions as a driving roller that circulates the transfer belt 31 in the direction of arrow A by power of a motor (not shown). By circulating the transfer belt 31 in the direction of arrow A, the first-transferred toner images for the corresponding colors are transported from first transfer positions T for the corresponding colors to the second transfer position NT.

Of the rollers 32, a roller 32T shown in FIG. 1 functions as a tension applying roller that applies tension to the transfer belt 31. Of the rollers 32, a roller 32B shown in FIG. 1 functions as an opposing roller of the second transfer roller 34. An apex at a lower end forming an obtuse angle of the transfer belt 31 disposed in the form of an inverted obtuse-angled triangle as mentioned above is wound upon the opposing roller 32B. With the transfer belt 31 disposed in the form of an inverted obtuse-angled triangle, an upper side portion of the transfer belt 31 extending in the width directions of the apparatus contacts the photoconductor drums 21 for the corresponding colors from therebelow.

First Transfer Rollers 33

Each first transfer roller 33, serving as a transfer member, is a roller that transfers a toner image on its corresponding photoconductor drum 21 to the transfer belt 31. The first transfer rollers 33 are disposed at an inner side of the transfer belt 31. The first transfer rollers 33 are disposed so as to oppose the photoconductor drums 21 for the corresponding colors with the transfer belt 31 being interposed therebetween. By a power supplying unit 37 (shown in FIG. 2), a first transfer voltage (first transfer current) having a polarity that is opposite to the polarity of toner is applied to its corresponding first transfer roller 33. By this, a transfer electric field is generated between the photoconductor drum 21 of each toner image forming unit 20 and its corresponding first transfer roller 33, so that an electrostatic force acts upon the toner image formed on each photoconductor drum 21, as a result of which the toner images are transferred to the transfer belt 31 at their corresponding first transfer positions T.

Second Transfer Roller 34

The second transfer roller 34, serving as a transfer member, is a roller that transfers the toner images superposed upon the transfer belt 31 to a recording medium P. As shown in FIG. 1, the second transfer roller 34 is disposed such that the transfer belt 31 is nipped between the second transfer roller 34 and the opposing roller 32B. The second transfer roller 34 and the transfer belt 31 are in contact with each other with a predetermined load. The second transfer position NT is formed between the second transfer roller 34 and the transfer belt 31 that are in contact with each other in this way. A recording medium P is supplied at a proper time from the holding unit 51 to the second transfer position NT. The second transfer roller 34 is rotationally driven in a clockwise direction in FIG. 1.

At the second transfer roller 34, a potential difference is produced between the opposing roller 32B and the second transfer roller 34 by applying a voltage having a negative polarity to the opposing roller 32B by a power supplying unit 80. That is, by applying a voltage having a negative polarity to the opposing roller 32B, a second transfer voltage (a voltage having a positive polarity) that is opposite to the toner polarity is indirectly applied to the second transfer roller 34 forming an opposing electrode of the opposing roller 32B. By this, a transfer electric field is generated between the opposing roller 32B and the second transfer roller 34, so that an electrostatic force acts upon the toner images formed on the transfer belt 31. Consequently, the toner images are transferred from the transfer belt 31 to the recording medium P that passes the second transfer position NT.

Fixing Device

The fixing device 40 (serving as an exemplary fixing unit) presses the toner images while heating the toner images at a fixing nip NF formed between a pressure roller 42 and a fixing belt 41 wound upon rollers 43, and fixes the toner images to the recording medium P.

Of the rollers 43, for example, a roller 43H serves as a driving roller. By rotationally driving the roller 43H, the fixing belt 41 circulates in the direction of arrow R.

A heat source 44, such as a halogen lamp, is provided in the roller 43H. The fixing belt 41 is heated by the heat source 44 through the roller 43H. A temperature sensor 45 is disposed so as to, for example, contact a surface of the fixing belt 41.

The pressure roller 42 rotates at a peripheral velocity that is equal to the peripheral velocity of the fixing belt 41 by a driving force that is transmitted from a motor (not shown).

Structure of Principal Portion

In the exemplary embodiment, the toner image forming unit 20V (exemplary first forming unit, exemplary forming unit) is constructed so as to form a toner image (exemplary first image) by using toner whose color is silver (special color (V)) (toner whose color is silver is hereunder referred to as "silver toner"). For the sake of description, the toner image formed by using silver toner is called a "silver image".

As shown in FIG. 7, silver toner 112 used in the toner image forming unit 20V includes pigments 110 (serving as exemplary flat pigments) and binder resin 111. Each pigment is formed of a metal, such as aluminum. When a pigment 110 that is placed in a plane is viewed from a side, as shown in FIG. 3B, the pigment 110 has a shape whose length in a left-right direction in FIG. 3B is longer than its length in an up-down direction. The ratio between the length of the pigment in the left-right direction and the length of the pigment in the up-down direction is greater than such a length ratio of each pigment of color toners described below. The particle diameter of the silver toner is greater than those of the color toners (described below). More specifically, the volume average particle diameter of each color toner is, for example, approximately 4 to 6 μm, whereas the volume average particle diameter of the silver toner is, for example, approximately 10 μm.

Figure 3A:
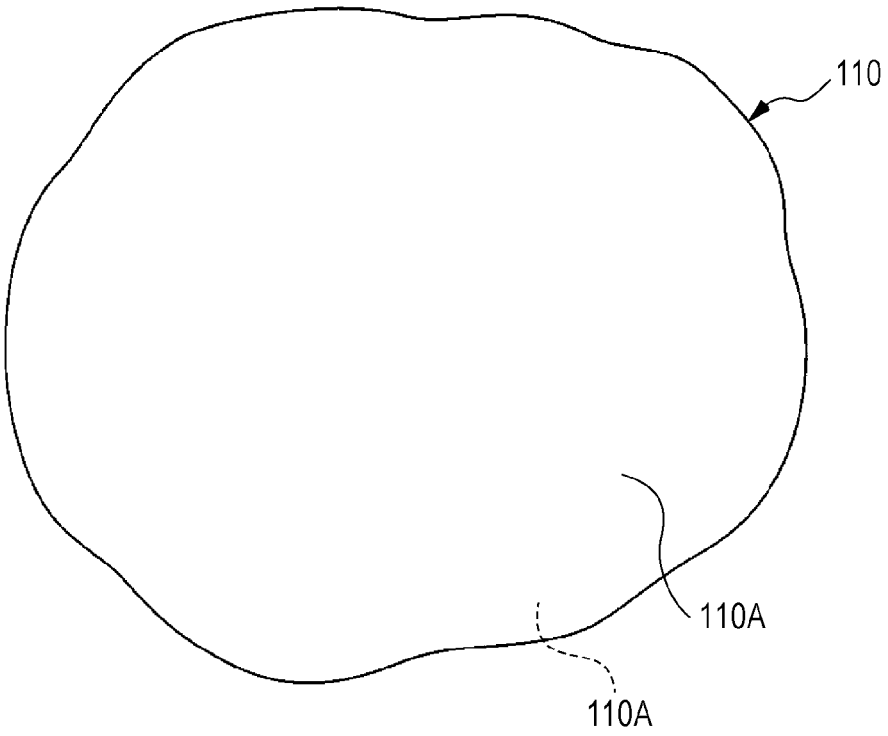
FIGS. 3A and 3B are, respectively, a plan view and a side view of a flat pigment according to the exemplary embodiment.
Figure 3B:
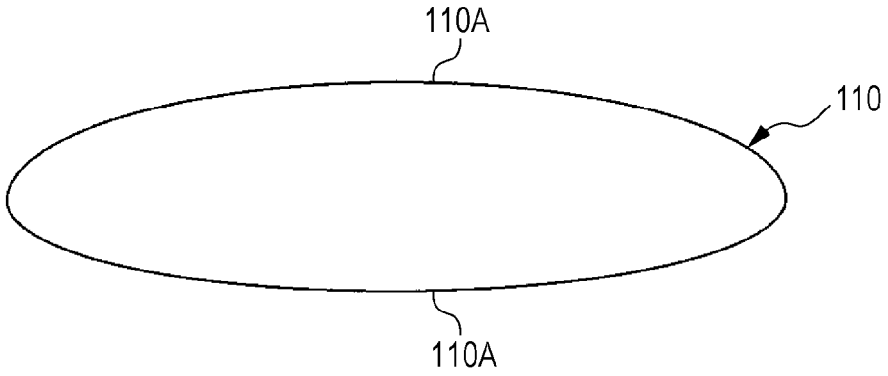

When the pigment 110 shown in FIG. 3B is viewed from the top, as shown in FIG. 3A, the pigment 110 has a shape that is wider than the shape viewed from the side. With the pigment 110 being placed in a plane (see FIG. 3B), the pigment 110 has a pair of reflecting surfaces 110A, one facing an upper side and the other facing a lower side. Accordingly, the pigment 110 is flat.

The yellow (Y) toner, the magenta (M) toner, the cyan (C) toner, and the black (K) toner, which are used in the toner image forming unit 20Y, the toner image forming unit 20M, the toner image forming unit 20C, and the toner image forming unit 20K (hereunder referred to as the "toner image forming units 20Y to 20K), respectively, do not contain flat pigments. They each contain pigments other than flat pigments (such as organic pigments or inorganic pigments) and binder resin. Compared to the pigments 110, such pigments have shapes that are close to a spherical shape. In the specification, for the sake of description, yellow (Y), magenta (M), cyan (C), and black (K) are called "colors", the toners for such colors are called "color toners", and toner images formed from such color toners are called "color images".

Accordingly, in the exemplary embodiment, the toner image forming units 20Y to 20K function as exemplary second forming units that form second images from toner not containing flat pigments on the basis of image information.

Here, in the exemplary embodiment, the controller 70 is formed so as to receive image formation instructions and job data from an external device (not shown).

The job data includes pieces of image data (exemplary image information) regarding toner images that are formed by the toner image forming unit 20V and the toner image forming units 20Y to 20K and other pieces of data accompanying such pieces of image data. The other pieces of data include, for example, data regarding the sizes of recording media P on which images are formed (that is, widths of recording media P in a direction crossing a transport direction). The pieces of image data include data regarding area coverage (%) for forming images and data regarding image widths.

The image formation instructions include, for example, silver image formation instructions, color image formation instructions, and mixed color image formation instructions. The silver image formation instructions include image formation instructions for forming a silver image on a recording medium P without forming color images on the recording medium P. The color image formation instructions include image formation instructions for forming color images on a recording medium P without forming a silver image on the recording medium P. The mixed color image formation instructions include image formation instructions for forming a silver image and color images on a recording medium P.

In the exemplary embodiment, the image forming apparatus 10 has a first mode in which, at a first fixing temperature, toner images including a silver image are fixed to a recording medium P, and a second mode in which, at a second fixing temperature that is higher than the first fixing temperature, toner images including a silver image are fixed to a recording medium P. The first fixing temperature is, for example, 155° C., and the second fixing temperature is, for example, 180° C.

The first mode is selected and executed by the controller 70 when a silver image having an area coverage that is greater than or equal to a predetermined area coverage occupies a width that is less than a predetermined width of a recording medium P.

The second mode is selected and executed by the controller 70 when a silver image having an area coverage that is greater than or equal to a predetermined area coverage occupies a width that is greater than or equal to a predetermined width of a recording medium P. More specifically, as described below, the controller 70 selects and executes each mode.

That is, when the controller 70 receives a silver image formation instruction or a mixed color image formation instruction, from job data, the controller 70 determines whether or not a silver image having an area coverage that is greater than or equal to 95% occupies a width that is greater than or equal to 50% of the width of a recording medium P. More specifically, on the basis of the job data, the controller 70 determines whether or not the ratio of the width of the silver image that is formed having an area coverage that is greater than or equal to 95% with respect to the width of the recording medium P on which the image is actually formed is greater than or equal to 50%.

The area coverage refers to the percentage of the number of pixels of a toner image that is developed by a developing device 24 with respect to the total number of pixels included per unit area when an exposure dot that is formed on a photoconductor drum 21 by an exposure device 23 is defined as one pixel.

The image width refers to a maximum width of the widths of a silver image along the width directions of a recording medium. The medium width refers to a maximum width of the widths of a recording medium P on which an image is actually formed.

Figure 4:
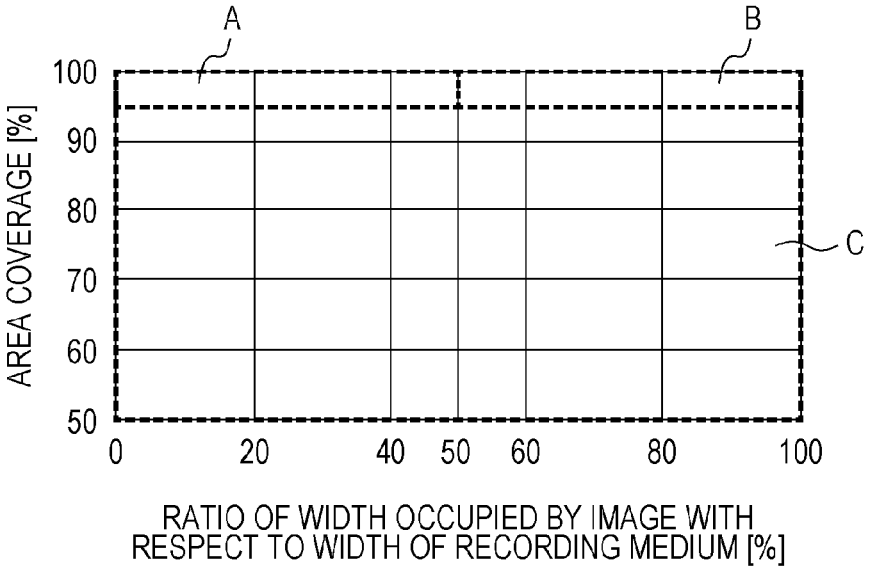
FIG. 4 is a graph showing mode selection conditions (area coverage and ratio of a width occupied by an image with respect to the width of a recording medium)

When, as a result of the aforementioned determination, it is determined that a silver image having an area coverage that is greater than or equal to 95% occupies a width that is less than 50% of the width of a recording medium (refer to area A surrounded by broken lines in FIG. 4), the controller 70 selects and executes the first mode. In the first mode, for example, on the basis of a temperature measurement value provided by the temperature sensor 45, the controller 70 controls an output of the heat source 44 of the fixing device 40, to maintain the first fixing temperature.

On the other hand, when, as a result of the aforementioned determination, it is determined that a silver image having an area coverage that is greater than or equal to 95% occupies a width that is greater than or equal to 50% of the width of a recording medium (refer to area B surrounded by broken lines in FIG. 4), the controller 70 selects and executes the second mode. In the second mode, for example, on the basis of a temperature measurement value provided by the temperature sensor 45, the controller 70 controls an output of the heat source 44 of the fixing device 40, to maintain the second fixing temperature.

Further, in the exemplary embodiment, when, in the case where a silver image and color images are to be formed on a recording medium P (that is, in the case where the controller 70 receives a mixed color image formation instruction), the second mode has been selected, the controller 70 sends to the toner image forming units 20Y to 20K an instruction for forming color images having area coverages that are smaller than the area coverage included in image data acquired by the controller 70. This causes the toner image forming units 20Y to 20K to form color images having area coverages that are smaller than the area coverage included in the image data.

When, in the case where a silver image and color images are to be formed on a recording medium P (that is, in the case where the controller 70 receives a mixed color image formation instruction), the first mode has been selected, the controller 70 sends to the toner image forming units 20Y to 20K an instruction for forming color images having area coverages that are equal to the area coverage included in the image data acquired by the controller 70. This causes the toner image forming units 20Y to 20K to form color images having area coverages corresponding to the area coverage included in the image data.

When, as the silver image, an image having an area coverage that is less than 95% is only provided (refer to an area C surrounded by broken lines in FIG. 4), or when a silver image is not to be formed on a recording medium P (that is, when only color images are to be formed on the recording medium P), the controller 70 selects and executes the first mode.

Here, when, in transferring the silver image to the recording medium P from the transfer belt 31, for example, the second transfer roller 34 is vibrated in axial directions thereof, the silver image is transferred to the recording medium P while the recording medium P alternately moves towards one side and the other side of the second transfer roller 34 in the axial directions relative to the second transfer roller 34. This changes the orientations of the pigments 110 of the silver toner of the transferred silver image in accordance with the vibration period. Periodic changes in the orientations of the pigments 110 cause periodic variation in the orientations of the pigments 110 of the silver image after the silver image has been fixed. That is, non-uniformity in the orientations of the pigments 110 shown in FIG. 5 of the fixed silver image occurs. When non-uniformity in the orientations of the pigments 110 occurs, unevenness in metallic gloss perceived due to light reflected from the pigments 110 occurs.

Figure 5:
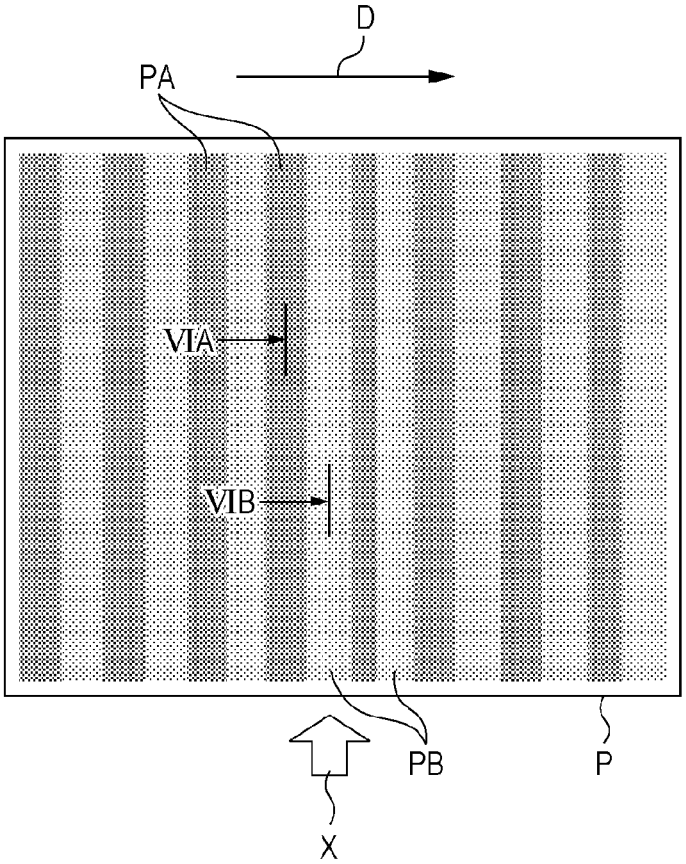
FIG. 5 illustrates non-uniformity in orientations of flat pigments (unevenness in metallic gloss) of an image formed on a recording medium.
Figure 6A:
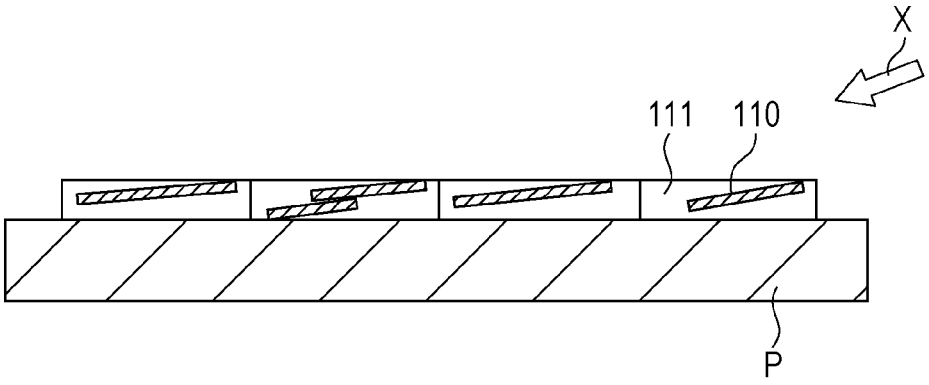
FIG. 6A is a sectional view taken along arrow VIA in FIG. 5.
Figure 6B:
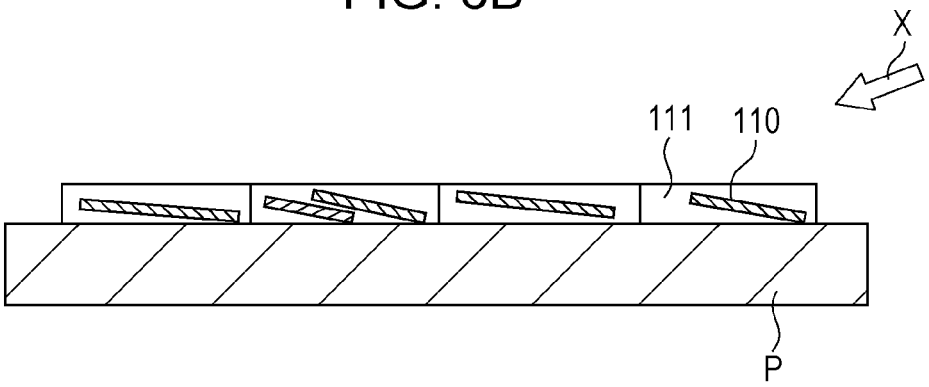
FIG. 6B is a sectional view taken along arrow VIB in FIG. 5.

In the example shown in FIG. 5, non-uniformity in which belt-shaped dark portions PA and belt-shaped bright portions PB extending in a direction crossing a transport direction D of a recording sheet P are alternately disposed side by side in the transport direction D occurs. This non-uniformity is one that is perceived when it is viewed in the direction of arrow X shown in FIG. 5. More specifically, as shown in FIG. 6A, the pigments 110 are oriented along a visual perception direction X, and reflected light towards a location at a visual perception side exists at a relatively low position. In contrast, as shown in FIG. 6B, the bright portions PB are oriented in a direction opposing the visual perception direction X, and reflected light towards the visual perception side exists at a relatively high position. FIG. 6A is a schematic sectional view taken along arrow VIA in FIG. 5. FIG. 6B is a schematic sectional view taken along arrow VIB in FIG. 5.

Further, when the area coverages of the toner images that are formed on the recording medium P are large, and the widths of the toner images are large, adhesion between the transfer belt 31 and the recording medium P is reduced, as a result of which the recording medium P tends to move relative to the transfer belt 31. Therefore, periodic variation in the orientations of the pigments 110 tends to occur. In addition, when the area coverages of the toner images that are formed on the recording medium P are large, and the widths of the toner images are large, if the orientations of some of the pigments 110 change, periodic variation in the orientations of the pigments 110 of the silver toner tends to be visually perceived as unevenness in metallic gloss.

The inventor has found out that, in particular, when a silver image having an area coverage that is greater than or equal to 95% occupies a width that is greater than or equal to 50% of the width of a recording medium P (refer to the area B surrounded by the broken lines in FIG. 4), the recording medium P tends to move relative to the transfer belt 31, and periodic variation in the orientations of pigments 110 of silver toner tends to be perceived as unevenness in metallic gloss.

Action of Principal Portion

Next, the action of the principal portion is described. Here, the action when the controller 70 receives a mixed color image formation instruction is described.

When the controller 70 receives a mixed color image formation instruction, the controller 70 causes the toner image forming unit 20V and the toner image forming units 20Y to 20K to operate (see FIG. 1). A silver image is formed on the photoconductor drum 21 of the toner image forming unit 20V, and color images are formed on the photoconductor drums 21 of the corresponding toner image forming units 20Y to 20K.

First, the silver image is transferred to the transfer belt 31 that circulates. Then, the color images are successively transferred to the transfer belt 31. This causes a toner image formed by superposing toner images of the corresponding colors to be formed on the transfer belt 31. This toner image is transferred to a recording medium P from the transfer belt 31 at the second transfer position NT.

The recording medium P to which the toner image has been transferred is transported from the second transfer position NT to the fixing nip NF of the fixing device 40 by the transporting belts 58. The fixing device 40 heats and presses the recording medium P that passes through the fixing nip NF. This causes the toner image transferred to the recording medium P to be fixed to the recording medium P.

Here, in the exemplary embodiment, when the controller 70 receives a mixed image formation instruction, from job data, the controller 70 determines whether or not the ratio of the width of the silver image that is formed having an area coverage that is greater than or equal to 95% with respect to the width of the recording medium P on which the image is actually formed is greater than or equal to 50%.

When, as a result of the determination, it is determined that the silver image having an area coverage that is greater than or equal to 95% occupies a width that is greater than or equal to 50% of the width of the recording medium, the controller 70 selects the second mode. When the second mode has been selected, the fixing device 40 fixes the toner images including the silver image at the second fixing temperature (such as 180° C.) that is higher than the first fixing temperature.

This causes silver toner (principally binder resin 111) to melt, and the viscoelasticity to be lower than that when the toner images are fixed at the first fixing temperature. Therefore, the fluidity of the silver toner is increased and, when the recording medium P is pressed at the fixing nip NF, the pigments 110 are disposed side by side in the direction of the plane of the recording medium P.

That is, prior to the fixing operation, the orientations of the pigments 110 that are random (see FIG. 7A) are maintained in the random state during the fixing operation at the first fixing temperature (see FIG. 7B), and become regular orientations by the fixing operation at the second fixing temperature (see FIG. 7C).

Therefore, in the second mode, compared to the case in which the fixing operation is performed at the first fixing temperature, periodic variation in the orientations of the pigments 110 contained in the silver toner of the silver image transferred to the recording medium P from the transfer belt 31 is reduced. This reduces the occurrence of unevenness in metallic gloss of the silver image formed on the recording medium P.

Further, when the second mode has been selected, an instruction for forming color images having area coverages that are smaller than the area coverage included in image data acquired by the controller 70 is sent to the toner image forming units 20Y to 20K. Then, the toner image forming units 20Y to 20K form color images having area coverages that are smaller than the area coverage included in the image data. By forming the color images having smaller area coverages, the surface of the recording medium P is exposed, and the unevenness of the surface allows the gloss of the toner images to be reduced.

By this, compared to the case in which the toner image forming units 20Y to 20K form color images having area coverages corresponding to the area coverage included in the image data, excessive increase in the gloss of the color images is reduced.

In contrast, when, as a result of determining whether or not the ratio of the width of the silver image having an area coverage that is greater than or equal to 95% with respect to the width of the recording medium P is greater than or equal to 50%, it is determined that the silver image having an area coverage that is greater than or equal to 95% occupies a width that is less than 50% of the width of the recording medium, the controller 70 selects the first mode. When the first mode has been selected, the fixing device 40 fixes the toner images including the silver image at the first fixing temperature (such as 155° C.)

By this, compared to the case in which the fixing operation is performed at the second fixing temperature, an excessive increase in the gloss of the color images is reduced. In addition, compared to the case in which the fixing operation is performed at the second fixing temperature, the amount of electric power that is consumed by the fixing device 40 is reduced.

When the first mode has been selected, the toner image forming units 20Y to 20K form color images having area coverages corresponding to the area coverage included in the image data.

Evaluation

By using an actual device (Color 1000 Press modified device produced by Fuji Xerox Co., Ltd.) having the structure of the above-described image forming apparatus 10, whether or not there is periodic variation in the orientations of flat pigments when silver images are fixed at different fixing temperatures is evaluated. In the evaluation, silver images having an area coverage of 100% are formed on the entire widths of recording media. In addition, in the evaluation, by visually confirming the metallic gloss of the fixed images, the periodic variation in the orientations of flat pigments is evaluated on the basis of the following:

A: Periodic variation in the orientations of flat pigments does not occur

B: Periodic variation in the orientations of flat pigments occurs slightly, but, practically speaking, is in an allowable range C: Periodic variation in the orientations of flat pigments occurs and, practically speaking, is in a range that becomes a problem As a result, as shown in FIG. 8, in the case where TMA is 4.5 g/m$^2$, when the fixing temperature is 155° C., the evaluation is C; and, when the fixing temperature is 180° C., the evaluation is A.

In the case where TMA is 5.0 g/m$^2$, when the fixing temperature is 150° C., the evaluation is C; when the fixing temperature is 160° C., the evaluation is B; and when the fixing temperatures are 170° C. and 180° C., the evaluation is A.

TMA (toner mass per area) refers to mass per unit area (g/m$^2$) of toner of a toner image transferred to a recording medium P, and is a value that is obtained by, before fixing the toner image to the recording medium P, attracting toner of a patch having a determined size and measuring the mass thereof.

Modification of First Exemplary Embodiment

In the exemplary embodiment, toner images are fixed at the first fixing temperature in an exemplary case in which the toner images are fixed with fixing energy having a first value. In addition, in the exemplary embodiment, toner images are fixed at the second fixing temperature that is higher than the first fixing temperature in an exemplary case in which the toner images are fixed with fixing energy having a second value that is greater than the first value of the fixing energy having the first value. That is, although, in the exemplary embodiment, an example in which the fixing temperatures are changed is described, the method for changing the fixing energy that is applied to the toner images is not limited thereto. For example, the fixing energy (quantity of heat) that is applied to the toner images may be changed by changing, for example, fixing pressure, fixing time, etc. Therefore, the fixing energy that is applied to the toner images during the fixing operation may be changed by changing at least one of the fixing temperature, the fixing pressure, and the fixing time.

Second Exemplary Embodiment

Next, an exemplary image forming apparatus according to a second exemplary embodiment of the present invention is described. Corresponding portions to those according to the first exemplary embodiment are given the same reference numerals, and are not described when appropriate.

Structure

A first mode in which a silver image is formed on the photoconductor drum 21 when TMA has a first value and a second mode in which a silver image is formed on the photoconductor drum 21 when TMA has a second value that is less than the first value are provided. The first value is, for example, 4.0 g/m$^2$, and the second value is, for example, 3.0 g/m$^2$.

As mentioned above, TMA (toner mass per area) refers to mass per unit area (g/m$^2$) of toner of a toner image transferred to a recording medium P, and is a value that is obtained by, before fixing the toner image to the recording medium P, attracting toner of a patch having a determined size and measuring the mass thereof.

TMA is controlled by adjusting the amount of toner that is supplied to a photoconductor drum 21 as a result of controlling, for example, charging potential of a charging unit 22, development voltage of a developing device 24, and the quantity of exposure light of an exposure device 23. In the second exemplary embodiment, even if TMA is changed, the area coverage does not change, so that the thickness (height) of a toner layer changes.

The first mode is selected and executed by the controller 70 when a silver image having an area coverage that is greater than or equal to a predetermined area coverage occupies a width that is less than a predetermined width of a recording medium P. More specifically, as in the first exemplary embodiment, the first mode is selected and executed by the controller 70 when a silver image having an area coverage that is greater than or equal to 95% occupies a width that is less than 50% of the width of a recording medium P (see the area A that is surrounded by broken lines in FIG. 4).

The second mode is selected and executed by the controller 70 when a silver image having an area coverage that is greater than or equal to a predetermined area coverage occupies a width that is greater than or equal to a predetermined width of a recording medium P. More specifically, as in the first exemplary embodiment, the second mode is selected and executed by the controller 70 when a silver image having an area coverage that is greater than or equal to 95% occupies a width that is greater than or equal to 50% of the width of a recording medium P (see the area B that is surrounded by broken lines in FIG. 4).

Action

Next, an action is described. Here, the action when the controller 70 has received a mixed color image formation instruction is described.

When the controller 70 receives a mixed color image formation instruction, the controller 70 causes the toner image forming unit 20V and the toner image forming units 20Y to 20K to operate (see FIG. 1). A silver image is formed on the photoconductor drum 21 of the toner image forming unit 20V, and color images are formed on the photoconductor drums 21 of the corresponding toner image forming units 20Y to 20K.

First, the silver image is transferred to the circulating transfer belt 31. Then, the color images are successively transferred to the transfer belt 31. This causes a toner image formed by superposing the toner images of the corresponding colors to be formed on the transfer belt 31. This toner image is transferred to a recording medium P from the transfer belt 31 at the second transfer position NT.

The recording medium P to which the toner image has been transferred is transported towards the fixing nip NF of the fixing device 40 from the second transfer position NT by the transporting belts 58. The fixing device 40 heats and presses the recording medium P that passes through the fixing nip NF. By this, the toner image transferred to the recording medium P is fixed to the recording medium P.

Here, in the second exemplary embodiment, when the controller 70 receives a mixed color image formation instruction, the controller 70 determines whether or not the ratio of the width of the silver image that is formed having an area coverage that is greater than or equal to 95% with respect to the width of the recording medium P on which the image is actually formed is greater than or equal to 50%.

When, as a result of the determination, it is determined that the silver image having an area coverage that is greater than or equal to 95% occupies a width that is greater than or equal to 50% of the width of the recording medium, the controller 70 selects the second mode. When the second mode has been selected, at the toner image forming unit 20V, the developing device 24 forms on the photoconductor drum 21 the silver image with a TMA having a second value (such as 3.0 g/m$^2$) that is less than a first value.

By this, compared to the case in which a silver image with a TMA having a first value is formed on the photoconductor drum 21, the heat capacity of the silver toner (principally the binder resin 111) is reduced, as a result of which the toner tends melt. Therefore, the viscoelasticity is reduced. Consequently, the fluidity of the silver toner is increased. When the recording medium P is pressed at the fixing nip NF, the pigments 110 are disposed side by side in the direction of a plane of the recording medium P.

That is, before the fixing operation, the orientations of the pigments 110 that are in a random state (see FIG. 9A), are such that their random state is maintained (see FIG. 9B) when the silver image with a TMA having a first value is formed; and the orientations become regular when the silver image with a TMA having a second value is formed (see FIG. 9C).

Therefore, in the second mode, compared to the case in which a silver image with a TMA having a first value (such as 4.0 g/m$^2$) is formed, periodic variation in the orientations of the flat pigments 110 included in silver toner of the silver image transferred to the recording medium P from the transfer belt 31 is reduced. Therefore, in the silver image formed on the recording medium P, the occurrence of unevenness in metallic gloss is reduced.

In contrast, when, as a result of determining whether or not the ratio of the width of the silver image having an area coverage that is greater than or equal to 95% with respect to the width of the recording medium P is greater than or equal to 50%, it is determined that the silver image having an area coverage that is greater than or equal to 95% occupies a width that is less than 50% of the width of the recording medium, the controller 70 selects the first mode. When the first mode has been selected, at the toner image forming unit 20V, the developing device 24 forms on the photoconductor drum 21 the silver image with a TMA having a first value (such as 4.0 g/m$^2$).

Therefore, compared to the case in which the silver image with a TMA having a second value is formed on the photoconductor drum 21, toner is not easily melted, as a result of which an excessive increase in the gloss of the color images is reduced.

Evaluation

By using an actual device (Color 1000 Press modified device produced by Fuji Xerox Co., Ltd.) having the structure of the above-described image forming apparatus 10, whether or not there is periodic variation in the orientations of flat pigments when silver images with different TMA values are formed is evaluated. In the evaluation, silver images having area coverages of 100% are formed on the entire widths of recording mediums. In addition, in the evaluation, by visually confirming the metallic gloss of fixed images, periodic variation in the orientations of flat pigments is evaluated on the basis of the following:

A: Periodic variation in the orientations of flat pigments does not occur

B: Periodic variation in the orientations of flat pigments occurs slightly, but, practically speaking, is in an allowable range C: Periodic variation in the orientations of flat pigments occurs and, practically speaking, is in a range that becomes a problem As a result, as shown in FIG. 10, in the case where the fixing temperature is 155° C., when TMA is 5.0 g/m$^2$, 4.5 g/m$^2$, and 4.0 g/m$^2$, the evaluation is C; and, when TMA is 3.0 g/m$^2$, the evaluation is A.

Modifications of First Exemplary Embodiment and Second Exemplary Embodiment

Although, in the above-described exemplary embodiments, the transfer belt 31 is used as a transfer body, the transfer body is not limited thereto. It is possible to use a structure in which toner images are transferred to a recording medium P from photoconductor bodies without being transferred through the transfer belt 31 (intermediate transfer body). In this case, the photoconductor bodies are used as transfer bodies.

Although, in the above-described exemplary embodiments, silver toner is used as toner containing flat pigments, toner containing flat pigments is not limited thereto. Toner having a metallic color, such as gold toner, may be used. Gold toner contains, for example, yellow pigments and flat pigments, such as aluminum pigments. That is, toner containing flat pigments may also contain pigments other than flat pigments.

Although, in the above-described exemplary embodiments, the case in which the area coverage of 95% corresponds to the predetermined area coverage is described, the predetermined area coverage is not limited thereto. The predetermined area coverage may be, for example, 90% or 100%.

Although, in the above-described exemplary embodiments, the case in which the predetermined width of the recording medium P is 50% of the width of the recording medium P is described, the predetermined width of the recording medium P is not limited thereto. The predetermined width of the recording medium P may be, for example, 40% or 60% of the width of the recording medium P.

The present invention is not limited to the exemplary embodiments. Various modifications, changes, and improvements may be made within a range that does not depart from the gist of the present invention. For example, two or more of the above-described modifications may be combined as appropriate.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a transfer body that transfers an image formed with toner containing a flat pigment to a recording medium; and a fixing unit that, when the image having an area coverage that is greater than or equal to a predetermined area coverage occupies a width that is less than a predetermined width of the recording medium, fixes the image to the recording medium with fixing energy having a first value, and that, when the image having the area coverage that is greater than or equal to the predetermined area coverage occupies a width that is greater than or equal to the predetermined width of the recording medium, fixes the image to the recording medium with fixing energy having a second value, the second value being greater than the first value.

2. The image forming apparatus according to claim 1, further comprising:

a first forming unit that forms, as the image, a first image with the toner containing the flat pigment; and a second forming unit that forms a second image with toner that does not contain the flat pigment on the basis of image information, the second forming unit forming the second image with an area coverage that is smaller than that included in the image information when the fixing unit fixes the first image to the recording medium with the fixing energy having the second value, wherein the first image and the second image are transferred to the transfer body.

3. The image forming apparatus according to claim 2, wherein, when the image having an area coverage that is greater than or equal to approximately 95% occupies a width that is less than approximately 50% of the width of the recording medium, the fixing unit fixes the image to the recording medium with the fixing energy having the first value, and, wherein, when the image having the area coverage that is greater than or equal to approximately 95% occupies a width that is greater than or equal to approximately 50% of the width of the recording medium, the fixing unit fixes the image to the recording medium with the fixing energy having the second value that is greater than the first value of the fixing energy having the first value.

4. The image forming apparatus according to claim 1, wherein, when the image having an area coverage that is greater than or equal to approximately 95% occupies a width that is less than approximately 50% of the width of the recording medium, the fixing unit fixes the image to the recording medium with the fixing energy having the first value, and, wherein, when the image having the area coverage that is greater than or equal to approximately 95% occupies a width that is greater than or equal to approximately 50% of the width of the recording medium, the fixing unit fixes the image to the recording medium with the fixing energy having the second value that is greater than the first value of the fixing energy having the first value.

5. An image forming apparatus comprising:

a transfer body that transfers an image to a recording medium;

a fixing unit that fixes the image to the recording medium; and a forming unit that forms the image that is transferred to the recording medium from the transfer body with toner containing a flat pigment, wherein, in the forming unit, when the image having an area coverage that is greater than or equal to a predetermined area coverage occupies a width that is less than a predetermined width of the recording medium, toner mass per unit area of the toner that forms the image has a first value, and, when the image having the area coverage that is greater than or equal to the predetermined area coverage occupies a width that is greater than or equal to the predetermined width of the recording medium, the toner mass per unit area has a second value that is less than the first value.

6. The image forming apparatus according to claim 5, wherein, in the forming unit, when the image having an area coverage that is greater than or equal to approximately 95% occupies a width that is less than approximately 50% of the width of the recording medium, the toner mass per unit area of the toner that forms the image has the first value, and wherein, in the forming unit, when the image having the area coverage that is greater than or equal to approximately 95% occupies a width that is greater than or equal to approximately 50% of the width of the recording medium, the toner mass per unit area has the second value that is less than the first value.

7. An image forming method comprising:

transferring an image formed with toner containing a flat pigment to a recording medium; and when the image having an area coverage that is greater than or equal to a predetermined area coverage occupies a width that is less than a predetermined width of the recording medium, fixing the image to the recording medium with fixing energy having a first value, and, when the image having the area coverage that is greater than or equal to the predetermined area coverage occupies a width that is greater than or equal to the predetermined width of the recording medium, fixing the image to the recording medium with fixing energy having a second value, the second value being greater than the first value.

* * * * *